US006478400B1

(12) United States Patent
Endo

(10) Patent No.: US 6,478,400 B1
(45) Date of Patent: Nov. 12, 2002

(54) PRINTING METHOD AND PRINTER THAT EFFECT DOT DROPOUT INSPECTION AND RECORDING MEDIUM PRERECORDED WITH PROGRAM THEREFORE

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 23 days.

(21) Appl. No.: 09/645,508

(22) Filed: Aug. 25, 2000

Related U.S. Application Data

(63) Continuation of application No. PCT/JP99/07386, filed on Dec. 27, 1999.

(30) Foreign Application Priority Data

Dec. 25, 1998 (JP) ..... 10-368694
Dec. 25, 1998 (JP) ..... 10-368698

(51) Int. Cl.[7] ..... B41J 2/01
(52) U.S. Cl. ..... 347/19
(58) Field of Search ..... 347/12, 19, 40; 400/74

(56) References Cited

U.S. PATENT DOCUMENTS 6,174,039 B1 * 1/2001 Miyake et al. ..... 347/12
6,334,660 B1 * 1/2002 Holstun et al. ..... 347/19

FOREIGN PATENT DOCUMENTS

| | | |
|---|---|---|
| EP | 0 863 004 | 9/1998 |
| JP | 6-079956 | 3/1994 |
| JP | 6-143548 | 5/1994 |
| JP | 6-320729 | 11/1994 |
| JP | 8-25764 | 1/1996 |
| JP | 8-187881 | 7/1996 |
| JP | 10-119307 | 5/1998 |
| JP | 10-217471 | 8/1998 |
| JP | 10-286963 | 10/1998 |
| JP | 11-48463 | 2/1999 |
| JP | 11-188853 | 7/1999 |

* cited by examiner

*Primary Examiner*—Craig Hallacher
(74) *Attorney, Agent, or Firm*—Oblon, Spivak, McClelland, Maier & Neustadt, P.C.

(57) ABSTRACT

An inspection is conducted to inspect for the presence/absence of jetting of ink droplets from nozzles subject to inspection, during a printing operation, to determine whether each nozzle subject to inspection is an operative nozzle capable of jetting ink droplets or an inoperative nozzle incapable of jetting ink droplets. When an inoperative nozzle is detected by the inspection, a first make-up operation is conducted for recording dots that should have been recorded by the inoperative nozzle by either unclogging the inoperative nozzle or using another active nozzle. The inspection may be conducted at every main scan during an ordinary printing operation when no inoperative nozzle is present. Further, cleaning may be conducted with respect to at least the inoperative nozzle when the inspection detects the inoperative nozzle, and the first make-up operation may be conducted when operation of the inoperative nozzle is not restored by a prescribed number of cleanings.

29 Claims, 15 Drawing Sheets

PRINT PROCESSING THAT CONDUCTS INSPECTION AFTER SCANNING

FLYING DROPLET INSPECTION METHOD (FIRST)

VIBRATING DIAPHRAGM INSPECTION METHOD

PRINT PROCESSING THAT CONDUCTS INSPECTION BEFORE SCANNING

PRINTING OPERATION WITHOUT MAKE-UP

PRINTING OPERATION WITH MAKE-UP

PRINT PROCESSING THAT CONDUCTS INSPECTION AFTER SCANNING

PRINT PROCESSING THAT CONDUCTS INSPECTION BEFORE SCANNING (WITH CLEANING)

PRINT PROCESSING THAT CONDUCTS INSPECTION AFTER SCANNING (WITH CLEANING)

PRINT PROCESSING THAT DISPLAYS GUIDANCE TO USER (FIRST)

GUIDANCE DISPLAY EXAMPLE 1

PRINT PROCESSING THAT DISPLAYS GUIDANCE TO USER (SECOND)

GUIDANCE DISPLAY EXAMPLE 2

PRINTING METHOD AND PRINTER THAT EFFECT DOT DROPOUT INSPECTION AND RECORDING MEDIUM PRERECORDED WITH PROGRAM THEREFORE

CROSS-REFERENCE TO RELATED APPLICATIONS

This document is a continuation of and claims priority on PCT/JP99/07386, Dec. 27, 1999 the entire contents of which are hereby incorporated herein by reference. This document is also related to Japanese Patent Application 10-168,684, the entire contents of which are hereby incorporated herein by reference.

BACKGROUND OF THE INVENTION

1. Field of the Invention

The present invention relates to a technology for printing images by jetting ink droplets from each of a plurality of nozzles to record dots on the surface of a printing medium, and particularly to a printing technology utilizing dot dropout inspection that inspects whether or not ink droplets are jetted from the nozzles.

2. Discussion of the Background

An inkjet printer prints images by jetting ink droplets from a plurality of nozzles. The print head of an inkjet printer is equipped with a large number of nozzles. Due to an increase in ink viscosity and/or bubble entrainment and the like, some of the nozzles may clog and become incapable of jetting ink droplets. Nozzle clogging becomes a cause of image quality degradation by causing dot dropout within the image.

The background way of inspecting for nozzle clogging is for the user to print a special test pattern on printing paper before starting a printing job and to then examine the printed test pattern visually. In this description, a "printing job" means the entire printing operation performed in response to a single user instruction.

Since inspection has been conducted only before the printing job, it has been impossible to obtain the desired image quality when dot dropout occurred in the course of the printing operation.

SUMMARY OF THE INVENTION

Accordingly, one object of the present invention is to provide novel technology enabling mitigation of image quality degradation even when dot dropout occurs in the course of a printing operation.

A further object of the present invention is to overcome the above-noted problems of the background art.

In order to attain at least part of the above objects of the present invention, an inspection is conducted to inspect the presence/absence of jetting of ink droplets from nozzles subject to inspection, during a printing operation to determine whether each nozzle subject to inspection is an operative nozzle capable of jetting ink droplets or an inoperative nozzle incapable of jetting ink droplets. In this arrangement, dots are made up using another nozzle that is operative when an inoperative nozzle is detected or by cleaning the inoperative nozzle and then using the cleaned nozzle, and thereby degradation of image quality by dot dropout occurring in the course of the printing operation can be mitigated.

The inspection is preferably conducted at every main scan during ordinary printing operation which is performed when no inoperative nozzle is present. In this arrangement, any inoperative nozzle that occurs can be detected in a short time.

Cleaning may be conducted with respect to at least the inoperative nozzle when the inspection detects the inoperative nozzle, and the make-up operation may be conducted when operation of the inoperative nozzle is not restored by a prescribed number of cleanings.

Further, when operation of the inoperative nozzle is restored within the prescribed number of cleanings, the make-up operation may be conducted for recording dots that should have been recorded by the inoperative nozzle using the restored active nozzle. In this arrangement, since dots that were not recorded can be recorded by the nozzle that should have been in charge of recording the dots, dot make-up can be readily conducted.

The make-up operation may be an operation of recording only dots on a main scanning line that should have been recorded by the inoperative nozzle using the other active nozzle or the restored active nozzle. In this arrangement, it is possible to prevent degradation of image quality that would occur if dots in other normally printed main scan lines should be overstruck during the make-up operation.

It is preferable that, in the make-up operation, i) before the make-up operation, a sub-scan feed of a transient first feed amount is conducted in order to position the active nozzle on the main scanning line including the dots that should have been recorded by the inoperative nozzle; and ii) after the make-up operation, a sub-scan feed of a transient second feed amount is conducted in order to position the plurality of nozzles at a nozzle position of the next main scan of the ordinary printing operation. In this arrangement, a make-up operation for eliminating dot dropout can be easily conducted without substantially changing the ordinary printing operation.

According to another aspect of the present invention, an inspection for the presence/absence of jetting of ink droplets from nozzles subject to inspection is conducted, during a printing operation, to determine whether each nozzle subject to inspection is an operative nozzle capable of jetting ink droplets or an inoperative nozzle incapable of jetting ink droplets, and when an inoperative nozzle is detected by the inspection, processing after the inspection is conducted in accordance with a processing procedure selected by a user. In this arrangement, a processing procedure suitable for the circumstances can be selected based on the user's judgment.

The present invention can be implemented in various modes including, for example, a printing method and device, a computer program for realizing the functions of the method or device, a storage medium recorded with the computer program, and data signals including the computer program embodied in a carrier wave.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 10 is a flowchart showing a print processing procedure in a fourth embodiment;

DESCRIPTION OF THE PREFERRED EMBODIMENTS

Figure 1:
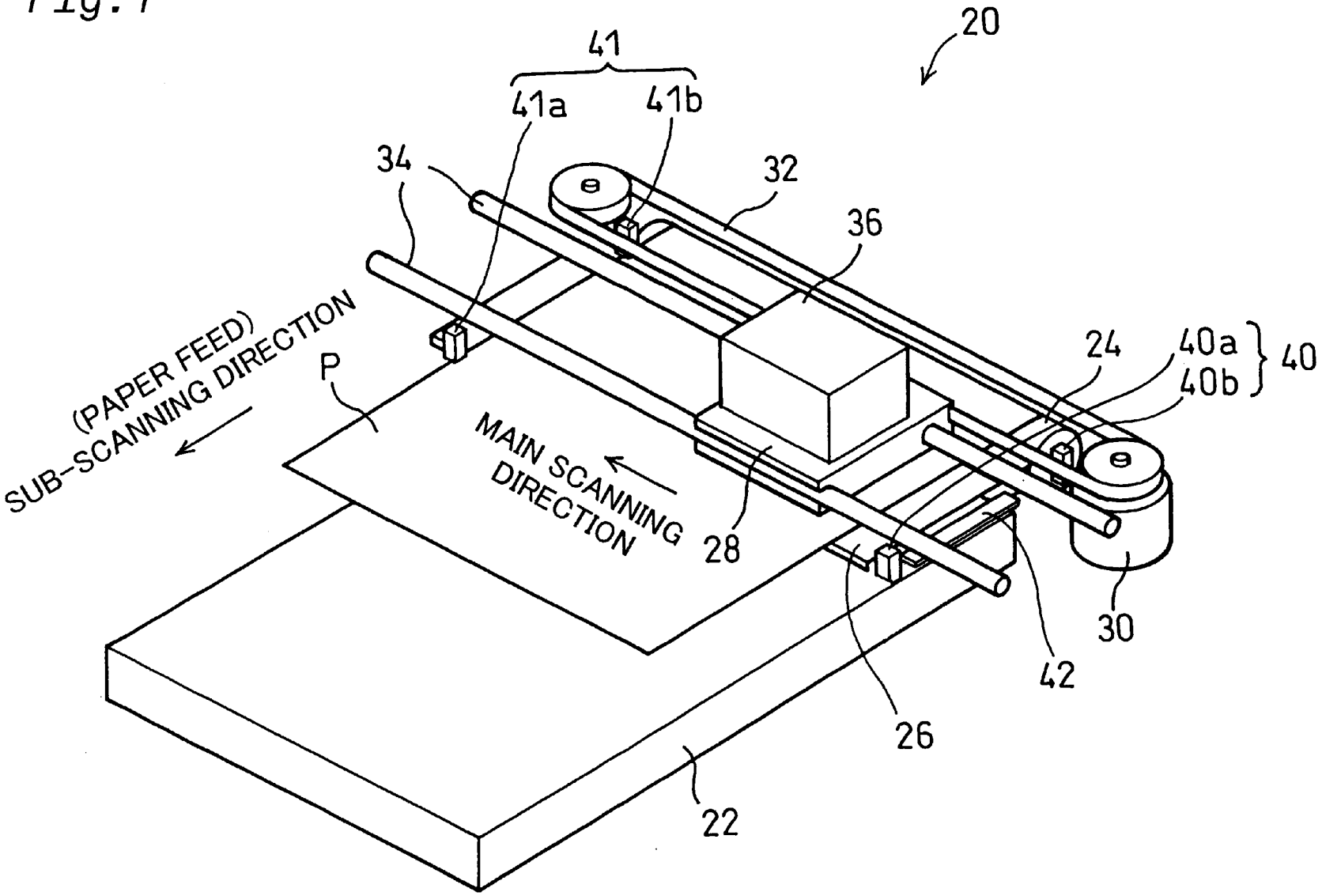
FIG. 1 is a schematic perspective view showing the main structure of a color inkjet printer embodying the present invention.

Referring now to the drawings, wherein like reference numerals designate identical or corresponding parts throughout the several views, the details of the embodiments of the present invention are now described.

Modes of implementing the present invention are now explained with reference to the following embodiments. FIG. 1 is a schematic perspective view showing the main structure of a color inkjet printer 20 embodying the present invention. The printer 20 is equipped with a sheet stacker 22, a paper feed roller 24 driven by a step motor (not shown), a platen plate 26, a carriage 28, a further step motor 30, a traction belt 32 driven by the step motor 30, and guide rails 34 for the carriage 28. A print head 36 equipped with a large number of nozzles is mounted on the carriage 28.

A first dot dropout inspection unit 40 is installed at a first standby position of the carriage 28 at the far right in FIG. 1 and a second dot dropout inspection unit 41 is installed at a second standby position at the far left. At the first standby position is also installed a third dot dropout inspection unit 42. The first dot dropout inspection unit 40 is equipped with a light-emitting element 40*a* and a light-receiving element 40*b*. Dot dropout inspection is conducted by using the elements 40*a* and 40*b* to check the flying state of ink droplets. The second dot dropout inspection unit 41 is similarly equipped with a light-emitting element 41*a* and a light-receiving element 41*b* and utilizes the same principle for dot dropout inspection as the first dot dropout inspection unit 40. The third dot dropout inspection unit 42 inspects for dot dropout by checking whether or not a diaphragm provided at its upper surface is being vibrated by ink droplets. The inspections conducted by the respective dot dropout inspection units are explained in detail below.

The paper feed roller 24 takes up the printing paper sheet P from the sheet stacker 22 and feeds the paper sheet P over the surface of the platen plate 26 in the sub-scanning direction. The carriage 28 is drawn by the traction belt 32 driven by the step motor 30 so as to move along the guide rails 34 in the main scanning direction. The main scanning direction is perpendicular to the sub-scanning direction.

Figure 2:
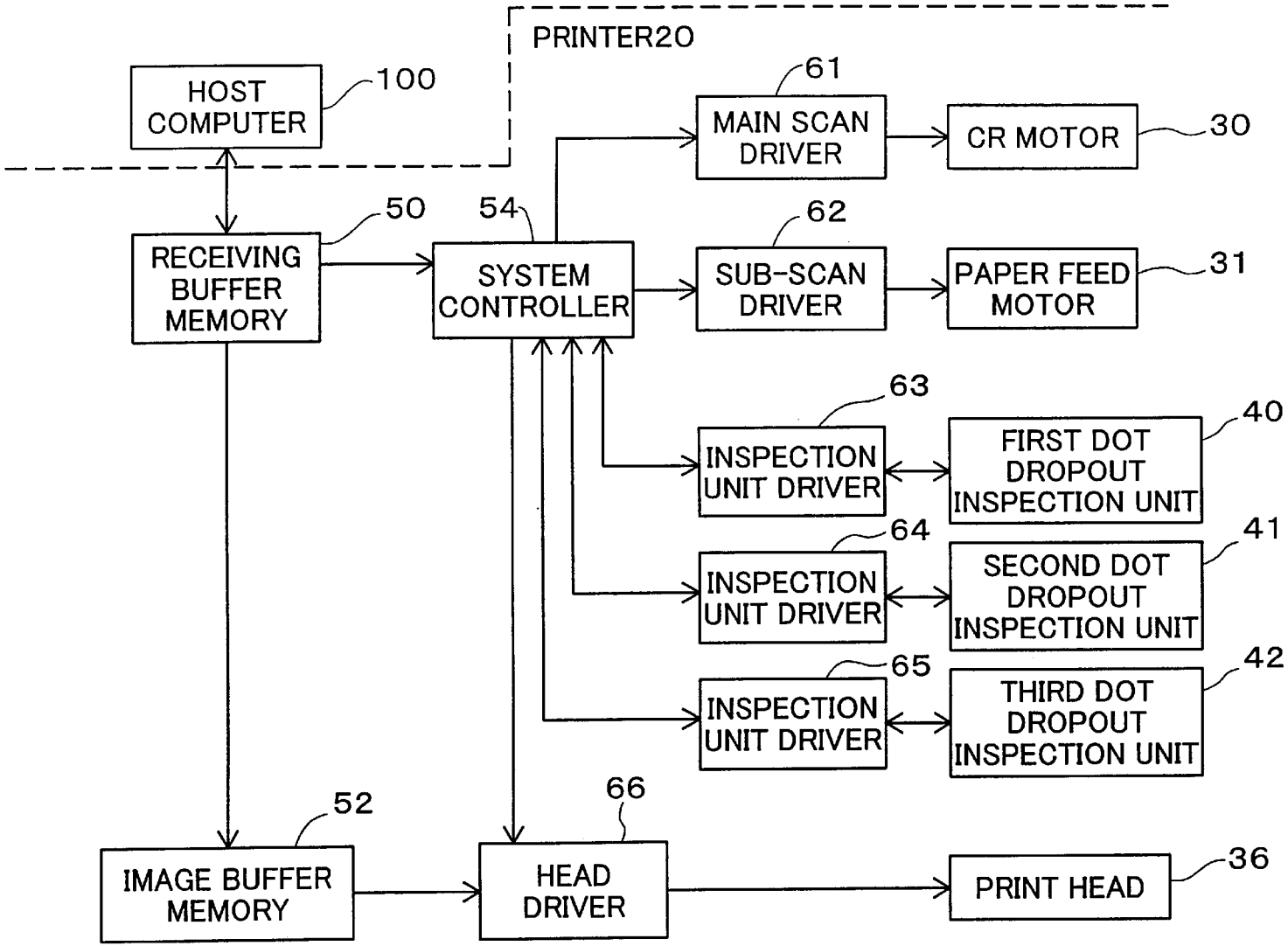
FIG. 2 is a block diagram showing the electrical configuration of the printer of FIG. 1.

FIG. 2 is a block diagram showing the electrical configuration of the printer 20. The printer 20 is equipped with a receiving buffer memory 50 for receiving signals supplied from a host computer 100, an image buffer memory 52 for storing print data, and a system controller 54 for controlling the overall operation of the printer 20. Connected to the system controller 54 are a main scan driver 61 for driving the step motor 30, a sub-scan driver 62 for driving the paper feed motor 31, inspection section drivers 63, 64, and 65 for driving the three dot dropout inspection units 40, 41, and 42, and a head driver 66 for driving the print head 36.

A printer driver (not shown) of the host computer 100 is responsive to the print mode (high-speed print mode, high-image-quality print mode etc.) selected by the user for determining various parameter values that regulate the printing operations. Based on the determined parameter values, the printer driver generates print data for printing in the selected print mode and transfers the generated data to the printer 20. The transferred print data are initially stored in the receiving buffer memory 50. Inside the printer 20, the system controller 54 reads required information from the print data stored in the receiving buffer memory 50 and sends control signals based thereon to the drivers 61–66.

The print data received by the receiving buffer memory 50 are separated into color components, and the image data for the respective color components are stored in the image buffer memory 52. The head driver 66 reads each color component of the image data from the image buffer memory 52 in response to control signals from the system controller 54 and drives a multi-color nozzle array provided on the print head 36 in accordance with the read data.

The functions of a cleaning unit for cleaning the print head 36 are implemented by the system controller 54 and the head driver 66. The functions of a make-up operation unit for conducting a make-up operation explained below are implemented by the system controller 54, the main scan driver 61, the sub-scan driver 62, and the head driver 66.

Figure 3:
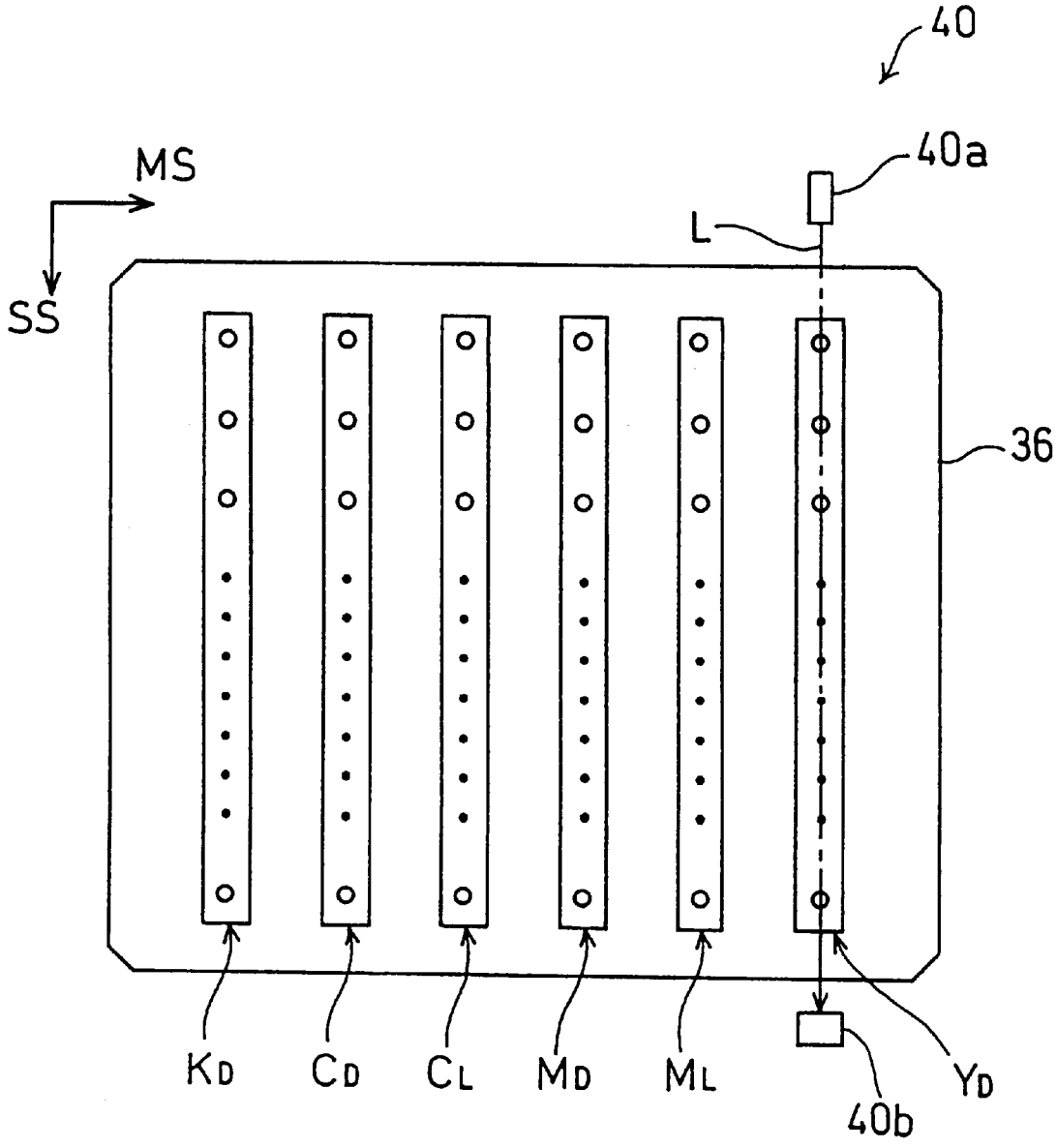
FIG. 3 is an explanatory diagram illustrating the structure of a first dot dropout inspection unit and the principle of its inspection method, referred to as the flying droplet inspection method.

FIG. 3 is an explanatory diagram illustrating the structure of the first dot dropout inspection unit 40 and the principle of its inspection method, referred to as the flying droplet inspection method. The second dot dropout inspection unit 41 is structurally and operationally the same as the first dot dropout inspection unit 40 and therefore is not explained separately. FIG. 3 is a view of the underside of the print head 36, showing a 6-color nozzle array of the print head 36 and the light-emitting element 40*a* and light-receiving element 40*b* constituting the first dot dropout inspection unit 40.

The undersurface of the print head 36 is formed with a black ink nozzle group $K_D$ for jetting black ink, a dark cyan ink nozzle group $C_D$ for jetting dark cyan ink, a light cyan ink nozzle group $C_L$ for jetting light cyan ink, a dark magenta ink nozzle group $M_D$ for jetting dark magenta ink, a light magenta ink nozzle group $M_L$ for jetting light magenta ink, and a yellow ink nozzle group $Y_D$ for jetting yellow ink.

In the reference symbols of the nozzle groups, the initial upper case character indicates the ink color, the subscript character "D" indicates an ink of relatively high depth of color, and the subscript character "L" indicates an ink of relatively low depth of color. The subscript character "$_D$" of the "yellow ink nozzle group $Y_D$" means that the yellow ink jetted from this nozzle group produces gray color when mixed with approximately equal amounts of dark cyan ink and dark magenta ink. The subscript character "$_D$" of the "black ink nozzle group $K_D$" means that the black ink jetted from this nozzle group is not gray but black of 100% depth of color.

The plurality of nozzles of each nozzle group are aligned in the sub-scan direction SS. During printing, the print head 36 jets ink from the nozzles while moving in the main scan direction MS together with the carriage 28 (FIG. 1).

The light-emitting element 40*a* is a laser that emits a light beam L of an outer diameter not greater than 1 mm. The light beam L is emitted in parallel with the sub-scan direction SS to be received by the light-receiving element 40*b*. During dot dropout inspection, first, as shown in FIG. 3, the print head 36 is positioned so that the nozzles of one color (e.g., the dark yellow $Y_D$ nozzles) are located above the path of the light beam L. In this state, the head driver 66 (FIG. 2) is used to operate the dark yellow Ynozzles successively one at a time and each for a prescribed drive period, and to thereby successively jet an ink droplet from each nozzle. As each jetted ink droplet blocks the path of the light beam L in the course of its flight, the light reception at the light-receiving element 40*b* is momentarily interrupted. Therefore, when an ink droplet is jetted normally from a given nozzle, it can be judged that the nozzle is not clogged from the fact that the light beam L is momentarily blocked from reaching the light-receiving element 40*b*. When the light beam L is not blocked whatsoever during the nozzle drive period, it can be judged that the nozzle is clogged. As reliable detection of whether or not the light beam L was blocked may be impossible with only a single ink droplet, several droplets are preferably jetted from each nozzle.

When inspection for clogging has been completed for all nozzles of one color, the print head 36 is moved in the main scanning direction in order to inspect the nozzles of the next color (the light magenta $M_L$ nozzles in the illustrated example).

This flying droplet inspection method inspects each nozzle for the presence/absence of clogging (and thus for presence/absence of dot dropout) by detecting jetted ink droplets during flight and is therefore advantageous in that the inspection can be completed in a relatively short time.

Figure 4:
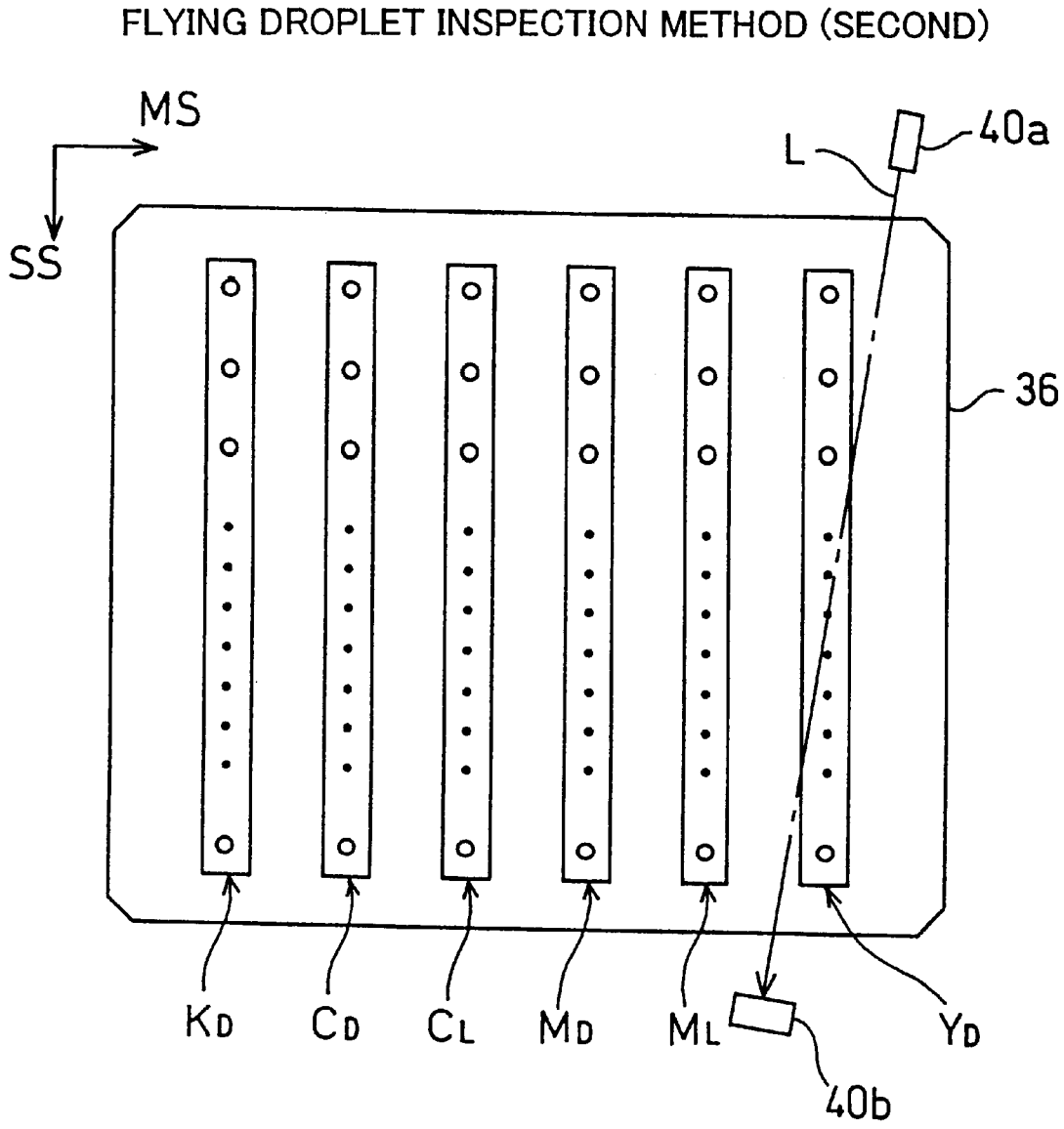
FIG. 4 is an explanatory diagram showing another structure of the first dot dropout inspection unit of FIG. 3.

FIG. 4 is an explanatory diagram showing another structure of the first dot dropout inspection unit 40. As shown in FIG. 4, the orientations of the light-emitting element 40*a* and the light-receiving element 40*b* are adjusted so that the direction of travel of the light beam L is inclined somewhat relative to the sub-scan direction SS. Specifically, the direction of travel of the light beam L is set so that when an ink drop jetted from one nozzle is being detected the light beam L is not blocked by ink droplets jetted from any other nozzle. In other words, it is set so that the path of the light beam L does not interfere with a plurality of paths of ink droplets from a plurality of nozzles.

When the light beam L is emitted in an oblique direction inclined with respect to the sub-scan direction SS in this way, every nozzle can be inspected for clogging by successively operating the nozzles, one by one, to jet ink droplets while slowly moving the print head 36 in the main scanning direction. This method is advantageous in that it enables inspection for clogging even with respect to nozzles whose jetted ink droplets deviate somewhat from the prescribed location or direction.

Figure 5:
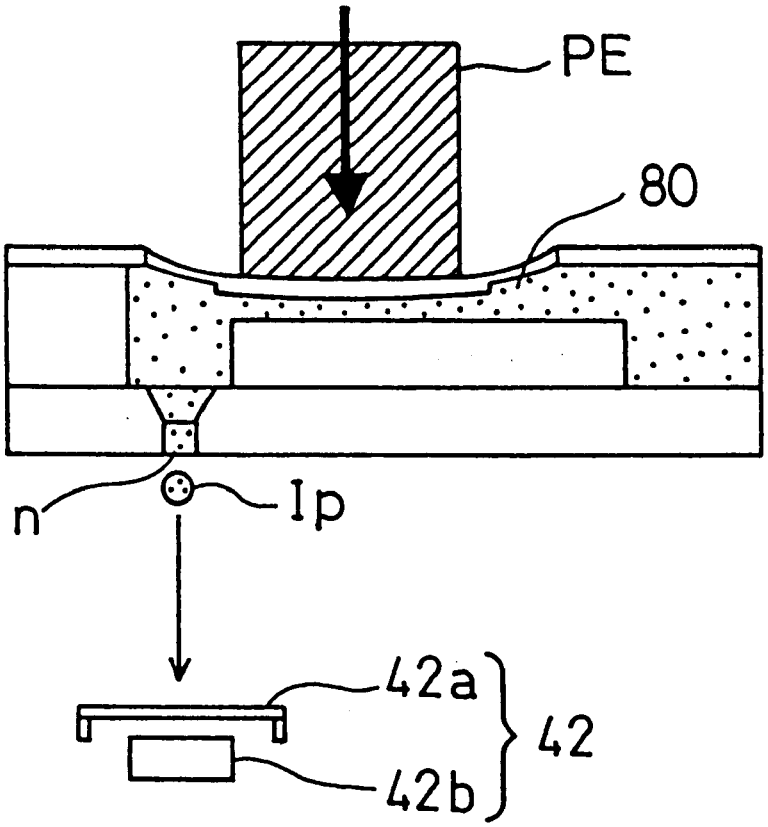
FIG. 5 is an explanatory diagram illustrating the structure of a further dot dropout inspection unit and the principle of its inspection method, referred to as the vibrating diaphragm inspection method.

FIG. 5 is an explanatory diagram illustrating the structure of the third dot dropout inspection unit 42 and the principle of its inspection method, referred to as the vibrating diaphragm inspection method. FIG. 5 is a sectional view taken in the vicinity of one nozzle n of the print head 36 and also shows a diaphragm 42*a* and a microphone 42*b* constituting the third dot dropout inspection unit 42.

A piezoelectric element PE provided in association with each nozzle n is located to be in contact with an ink passage 80 for conducting ink to the nozzle n. When a voltage is applied to the piezoelectric element PE, it elongates to deform one wall of the ink passage 80. The volume of the ink passage 80 is therefore reduced in proportion to the elongation of the piezoelectric element PE, thereby jetting an ink droplet Ip from the tip of the nozzle n at high speed.

When the ink droplet Ip jetted from the nozzle n reaches the diaphragm 42*a*, the diaphragm 42*a* vibrates. The microphone 42*b* converts the vibration of the diaphragm 42*a* into an electric signal. Whether or not an ink droplet Ip reached the diaphragm 42*a* (and thus whether or not the nozzle is clogged) can therefore be ascertained by detecting the output signal (noise signal) from the microphone 42*b*.

Such pairs of diaphragms 42*a* and microphones 42*b* are preferably arranged in the sub-scanning direction in a number equal to the number of nozzles of one color. This enables all nozzles of each color to be simultaneously inspected for the presence/absence of clogging. If ink droplets Ip are simultaneously jetted from adjacent nozzles, however, erroneous detection may occur due to interference between adjacent diaphragms 42*a*. Such erroneous detection is therefore preferably prevented by carrying out simultaneous inspection on sets of nozzles whose members are separated by several intervening nozzles.

Although three dot dropout inspection units 40–42 are shown in FIG. 1, it is adequate for a printer to be equipped with a single dot dropout inspection unit. In the case of a printer that can perform bi-directional printing, however, two dot dropout inspection units are preferably installed, one at either end of the main scan range of the carriage 28. This enables the two dot dropout inspection units to conduct inspection at the completion of every forward main scan and at the completion of every reverse main scan. Dot dropouts can therefore be detected more quickly than when only a single dot dropout inspection unit is provided.

The following various dot dropout inspection timings (1)–(4) are conceivable:

(1) before the start of a printing job;

(2) once every printed page (before printing or after printing);

(3) once every main scan (before main scanning or after main scanning); and (4) once every pixel (before recording or after recording a dot of every pixel).

Inspection can be conducted at the times of (1)–(3) using the dot dropout inspection units shown in FIG. 1. When it is desired to conduct inspection at the timing of (4), this can be achieved by installing numerous first dot dropout inspection units 40 on the side faces of the carriage 28 with the nozzle array located between their light-emitting elements 40*a* and light-receiving element 40*b*.

From the viewpoint of detecting dot dropout as quickly as possible, it is preferable to conduct inspection every pixel or every main scan. This embodiment is provided with the first and second dot dropout inspection units 40 and 41 at opposite ends of the scan range of the carriage 28. The printing operation will therefore be explained with regard to the case of using at least one of the first and second dot dropout inspection units 40 and 41 to conduct inspection once every main scan.

Figure 6:
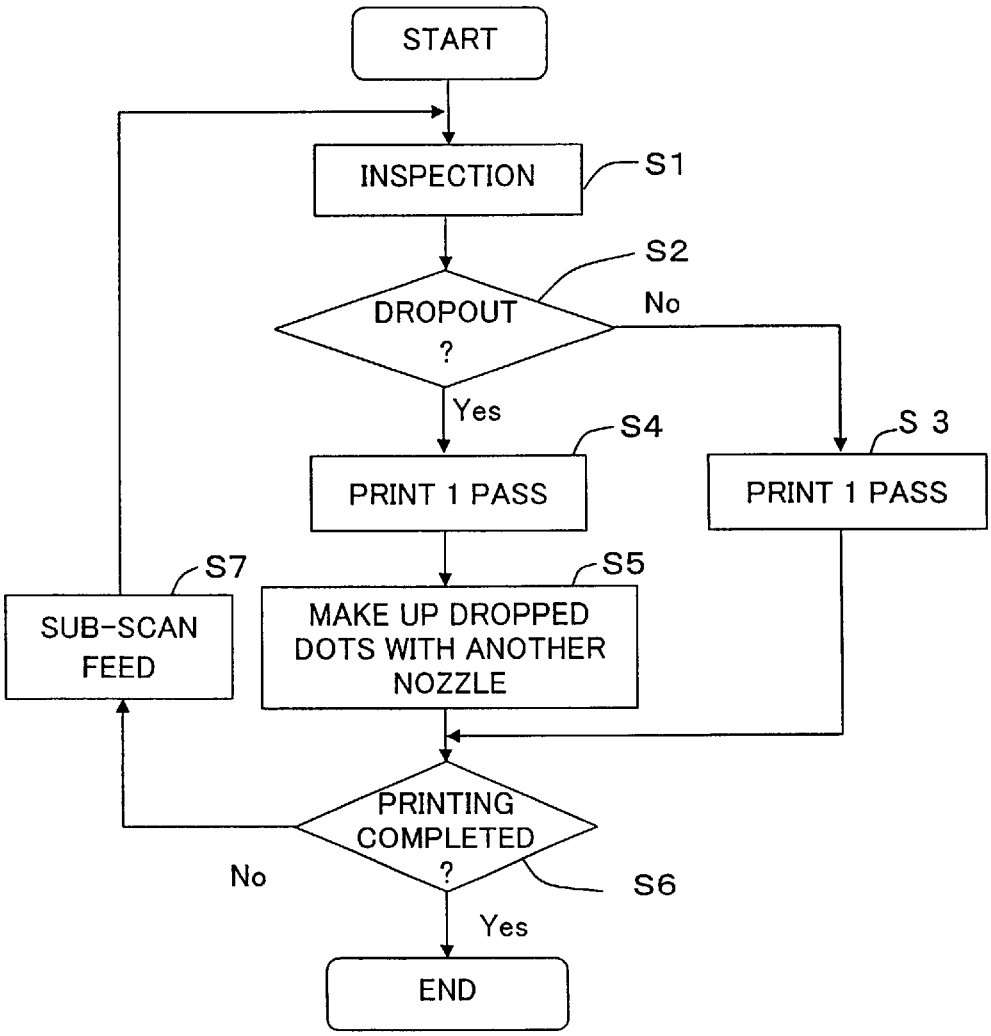
FIG. 6 is a flowchart showing the print processing procedure in a first embodiment.

FIG. 6 is a flowchart showing the print processing procedure in a first embodiment of the present invention. In the first embodiment, dot dropout inspection is conducted before every main scan. In step SI, the first dot dropout inspection unit 40 is used to conduct dot dropout inspection of all nozzles for six colors with the carriage 28 located at the first standby position. Although the following explanation is, unless otherwise stated, made with respect to use of the first dot dropout inspection unit 40, either of the second and third dot dropout inspection units 41 and 42 can be used instead.

When there is found to be no dot dropout in step S2, a printing pass is conducted in step S3. In this description, one main scan during printing operation is called a "pass." In the case of bi-directional printing, a single scan in the forward direction is one pass and a single scan in the reverse direction is also one pass. When one printing pass has been completed, a check is made in step S6 as to whether printing of one page has been completed. When it has not been completed, a sub-scan feed for an ordinary printing operation is conducted in step S7 and control is returned to step S1.

When the presence of dot dropout is found in step S2, a printing pass is conducted in step S4 and then, in step S5, a make-up operation is conducted with another nozzle to make up the dropped dots.

Figure 7A:
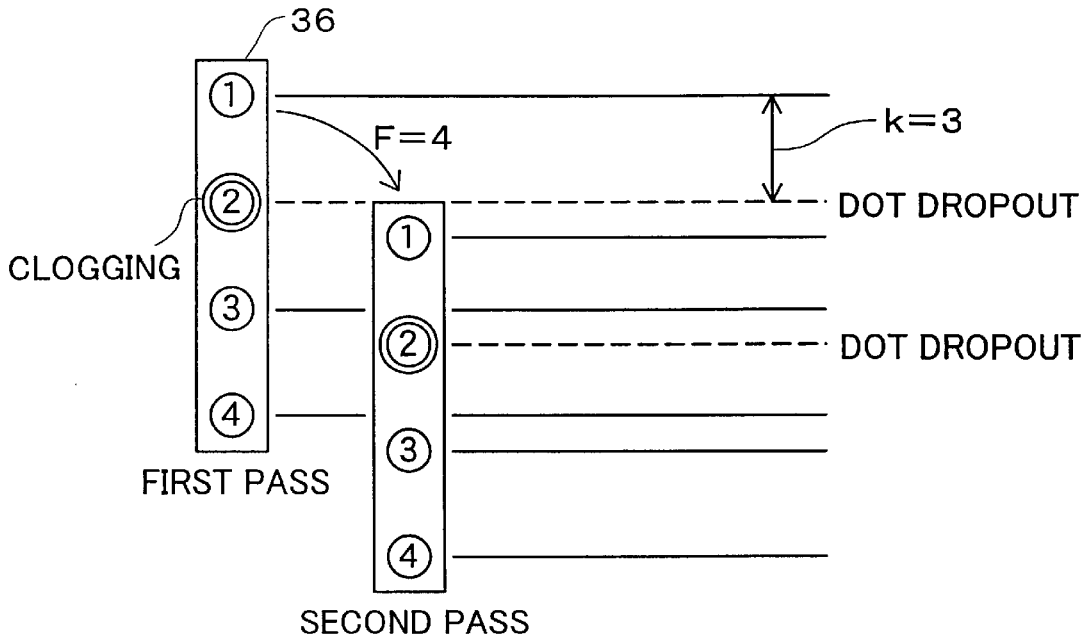
FIGS. 7(A) and 7(B) are explanatory diagrams showing an example of a make-up operation.
Figure 7B:
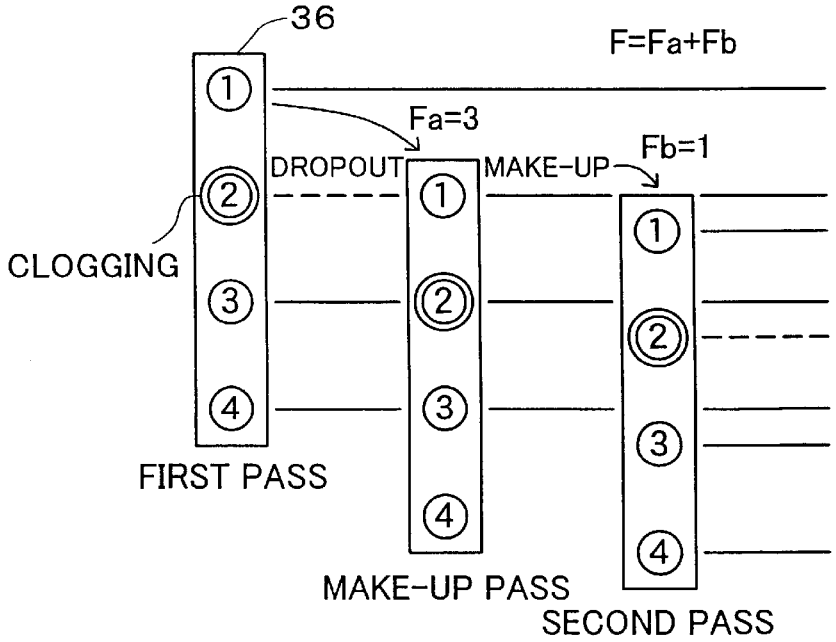

FIGS. 7(A) and 7(B) are explanatory diagrams showing an example of a make-up operation. In FIGS. 7(A) and 7(B), for simplicity it is assumed that the print head 36 has only four nozzles, that the second nozzle is the inoperative nozzle (clogged nozzle) and that the other nozzles are operating nozzles (nozzles that have not clogged). It is further assumed that the nozzle pitch k is three dots and that sub-scan feed is conducted at a constant feed amount F of four dots. FIG. 7(A) shows the printing operation when make-up is not conducted. Since the second nozzle is clogged, no dots are recorded on the raster line indicated by the broken line during the first printing pass. Unless a make-up operation is carried out, printing passes are successively conducted with this raster line being left without any dots formed thereon.

FIG. 7(B) shows the printing operation when a make-up operation is conducted. As in FIG. 7(A), dot dropout occurs during the first printing pass. However, since the inspection in step S1 of FIG. 6 detects that the second nozzle is an inoperative nozzle, the fact that dot dropout occurred on the raster line indicated by the broken line is also recognized. In the make-up operation following the first pass (step S5), therefore, a transient sub-scan feed of feed amount Fa is conducted to position an operative nozzle on the raster line (indicated by the broken line) where the dot dropout occurred during the first pass. In the example of FIG. 7(B), the first nozzle is positioned on the raster line that experienced the dot dropout by setting the transient sub-scan amount Fa at three dots. One pass is conducted in this condition to perform a recording operation with the first nozzle on the raster line that experienced the dot dropout. For performing this make-up operation, the first-pass print data are retained in the image buffer memory 52 (FIG. 1) even after completion of the first printing pass and those print data for the raster line that experienced the dot dropout among the retained print data are used to carry out the make-up operation. A main scan that effects a make-up operation is hereinafter referred to as a "make-up pass."

Although a make-up pass need only record dots on the raster line that experienced dot dropout, it can also be used to record dots on other raster lines at the same time. In other words, it suffices for a make-up pass to again conduct recording of dots on at least one raster line including the raster line that experienced dot dropout. Recording of dots only on the raster line that experienced dot dropout is, however, advantageous in the point that higher image quality can be achieved because unnecessary overstriking of dots on normally printed raster lines can be avoided. It also has the advantage of saving ink.

In the procedure of FIG. 6, a printing pass is conducted in step S4 and a make-up operation is then conducted in step S5. However, the order of these steps can be reversed. Specifically, a make-up operation can first be conducted on a raster line that is to experience dropout in the ordinary printing pass and the ordinary printing pass can be conducted thereafter.

Upon completion of a make-up pass, a check is made in step S6 as to whether printing of one page has been completed. If it has not been completed, a sub-scan feed is conducted in step S7 and control is returned to step S1. It should, however, be noted that, as shown in FIG. 7(B), the feed amount Fb of the sub-scan feed (second transient feed) conducted after the first make-up pass is set such that the sum of it and the feed amount Fa of the first transient feed (Fa+Fb) is equal to the feed amount F in an ordinary printing operation. By "feed amount F in an ordinary printing operation" is meant the normal feed amount when no dot dropout has occurred. It should be noted that the feed amount F in an ordinary printing operation may be set to a different value every pass. When two transient sub-scan feeds are thus conducted before and after a make-up pass so as to obtain the same feed amount as in a single ordinary sub-scan feed, the print head 36 can be properly positioned at the location of the next pass of the ordinary printing operation. Dot dropout make-up can therefore be readily conducted without modifying the overall printing operation. The make-up operation is controlled by the system controller 54.

Figure 8A:
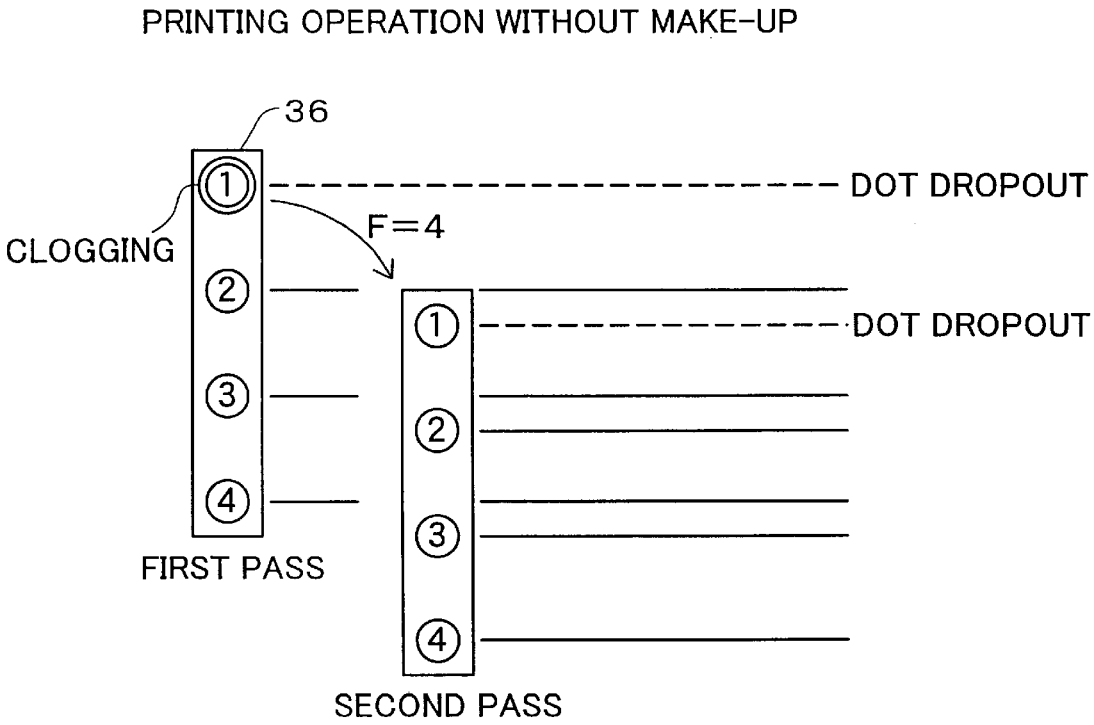
FIGS. 8(A) and 8(B) are explanatory diagrams showing another example of a makeup operation.
Figure 8B:
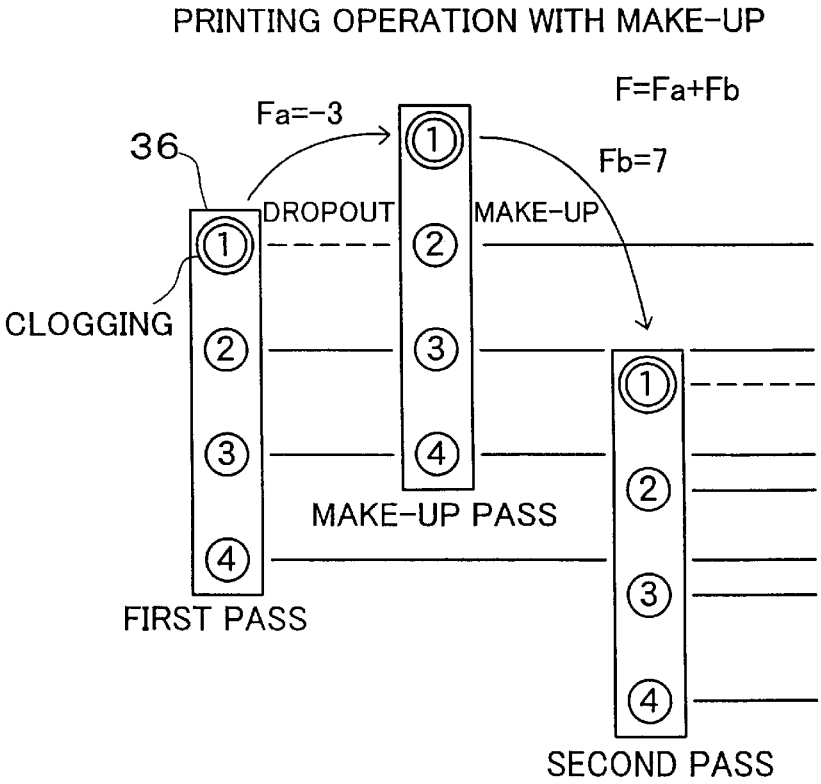

FIGS. 8(A) and 8(B) are explanatory diagrams showing another example of a makeup operation. In FIGS. 8(A) and 8(B), the first nozzle is an inoperative nozzle and the other nozzles are operative nozzles. FIG. 8(A) shows the printing operation when make-up is not conducted, and FIG. 8(B) shows the printing operation when make-up is conducted. In this example, the inoperative nozzle (the first nozzle) is rearmost in the sub-scanning direction. Another nozzle that is operative therefore cannot be positioned on the raster line that experienced the dot dropout by setting a positive value for the feed amount Fa of the first transient feed. So, instead, the feed amount Fa of the first transient feed is set to a negative value (3 dots in FIG. 8(B)) to position another nozzle that is operative (the second nozzle) on the raster line that experienced the dot dropout. Further, as in the case of FIG. 7(B), the feed amount Fb of the second transient feed conducted upon completion of the make-up pass is set so that the sum of it and the feed amount Fa of the first transient feed (Fa+Fb) is equal to the feed amount F in an ordinary printing operation.

Even in the case of FIG. 7(B), the first transient feed Fa can, as in the case of FIG. 8(B), be also set at a negative value. However, a sub-scan feed with a negative feed amount value (a "back feed") may involve a relatively large feed error owing to the effect of sub-scan feed mechanism backlash. Since a large feed error degrades image quality, a positive value is preferably adopted as the transient feed amounts Fa, Fb so far as possible.

When, in the foregoing manner, dot dropout inspection is conducted before every pass and a make-up operation is carried out using another nozzle that is operative when an inoperative nozzle is detected, a high-quality image free of dot dropout can be printed.

Figure 9:
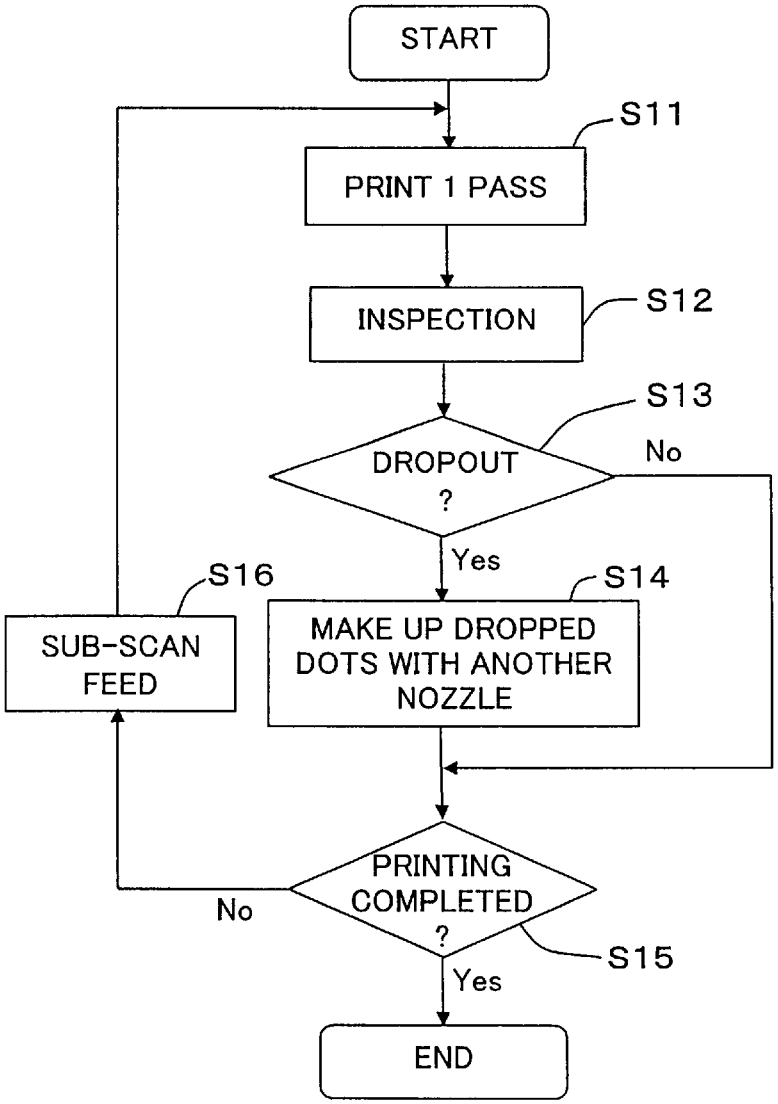
FIG. 9 is a flowchart showing a print processing procedure in a second embodiment.

FIG. 9 is a flowchart showing a print processing procedure in a second embodiment of the present invention. In the second embodiment, dot dropout inspection is conducted after every main scan. A printing pass is conducted in step S11. Next, in step S12, the first dot dropout inspection unit 40 is used to conduct dot dropout inspection of all nozzles for six colors.

When no dot dropout is found in step S13, control passes to step S15, in which a check is made as to whether printing of one page has been completed. When it has not been completed, a sub-scan feed of an ordinary printing operation is conducted in step S16 and control is returned to step S11.

When the presence of dot dropout is found in step S13, a make-up operation is conducted with another nozzle in step S14. In other words, dots are recorded on the raster line that experienced the dot dropout with another nozzle that is operative. The specific method for the processing of step S14 is the same as the one explained with regard to FIGS. 10 7(A)-7(B) and 8(A)-8(B). After this make-up operation, a check is made in step S15 as to whether printing of one page has been completed. When it has not been completed, a sub-scan feed is conducted in step S16 and control is returned to step S11. A high-quality image free of dot dropout can also be printed by carrying out inspection after each scan in this manner.

In the foregoing first and second embodiments, dot dropout inspection is conducted every scan and a make-up operation is carried out using another nozzle that is operative when dot dropout is detected. Therefore, even if dot dropout should occur in the course of a scan, the dot dropout can be quickly detected and the dot dropout on the printing medium can be easily eliminated.

Figure 10:
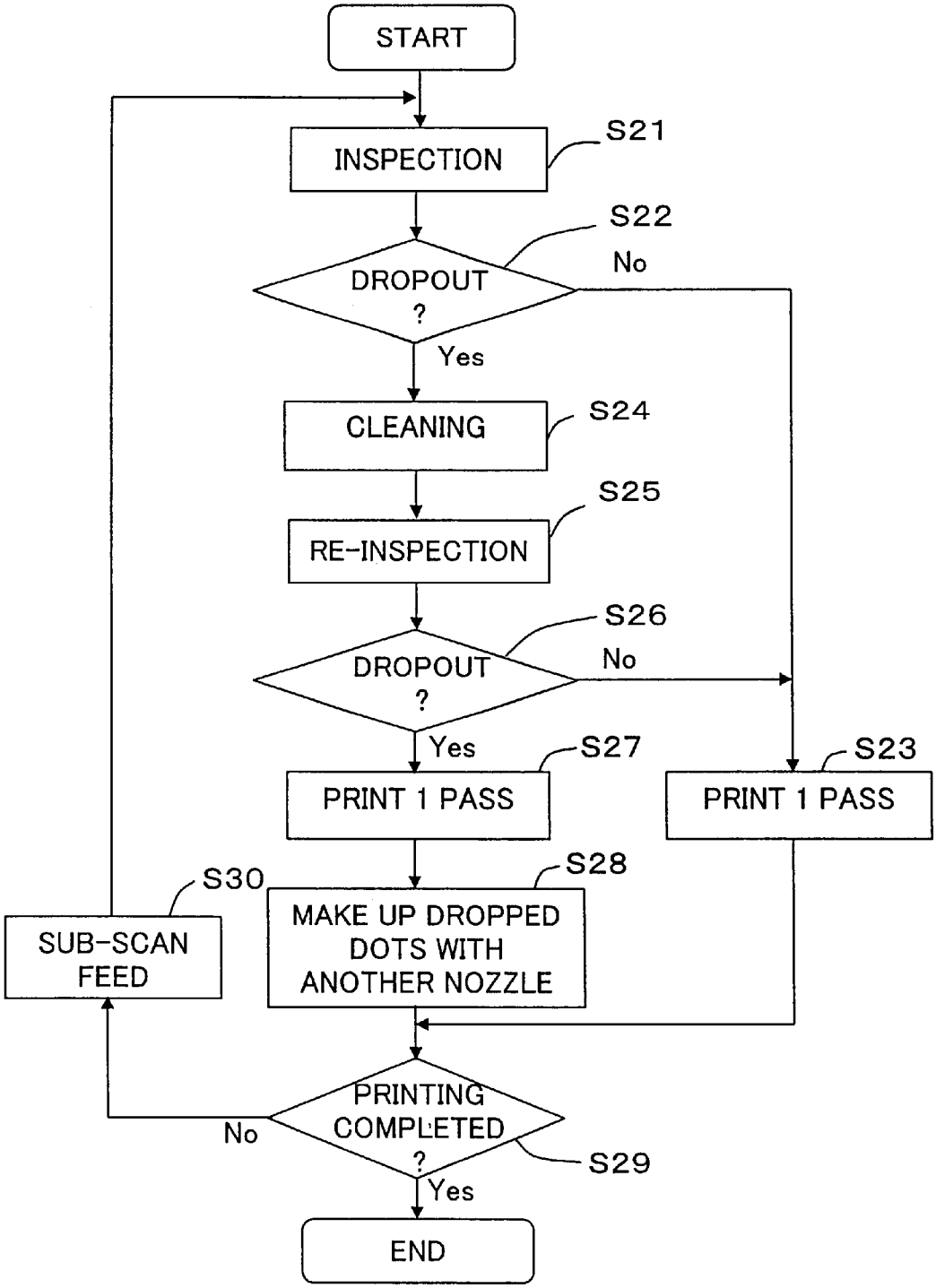
FIG. 10 is a flowchart showing a print processing procedure in a third embodiment.

FIG. 10 is a flowchart showing a print processing procedure in a third embodiment of the present invention. In the third embodiment, dot dropout inspection is conducted before every main scan and nozzle cleaning is conducted when dot dropout is detected. In step S21, the first dot dropout inspection unit 40 is used to conduct dot dropout inspection of all nozzles for six colors.

When no dot dropout is found in step S22, a printing pass is conducted in step S23. When the printing pass has been completed, a check is made in step S29 as to whether printing of one page has been completed. When it has not been completed, a sub-scan feed of an ordinary printing operation is conducted in step S30 and control is returned to step S21.

When the presence of dot dropout is found in step S22, nozzle cleaning is conducted in step S24. This cleaning can be carried out on all nozzles of the print head 36 or on only the clogged nozzle(s).

Next, in step S25, all nozzles are again inspected for dot dropout. If it is found in step S26 that all nozzle clogging has been eliminated, i.e., no dot dropout is present, control passes to step S23, in which a printing pass is conducted, and then to step S29. On the other hand, when it is found that nozzle clogging has not been eliminated, i.e., that dot dropout is still present, a printing pass is conducted in step S27 and then, in step S28, a make-up operation is conducted with another nozzle to make up the dropped dots. The specific method for the processing of step S28 is the same as the one explained with regard to FIGS. 7(A)–7(B) and 8(A)–8(B).

In the procedure of FIG. 10, a printing pass is conducted in step S27 and a make-up operation is then conducted in step S28. However, the order of these steps can be reversed. Specifically, a make-up operation can first be conducted on a raster line that is to experience dropout in the ordinary printing pass and the ordinary printing pass can be conducted thereafter.

Upon completion of a make-up pass, a check is made in step S29 as to whether printing of one page has been completed. If it has not been completed, a sub-scan feed is conducted in step S30 and control is returned to step S21. As shown in FIG. 7(B), the feed amount Fb of the sub-scan feed (second transient feed) conducted after the make-up pass is set such that the sum of it and the feed amount Fa of the first transient feed (Fa+Fb) is equal to the feed amount F in an ordinary printing operation.

When, in the foregoing manner, dot dropout inspection is conducted before every pass and a make-up operation is carried out using another nozzle that is operative when an inoperative nozzle is detected, a high-quality image free of dot dropout can be printed.

Figure 11:
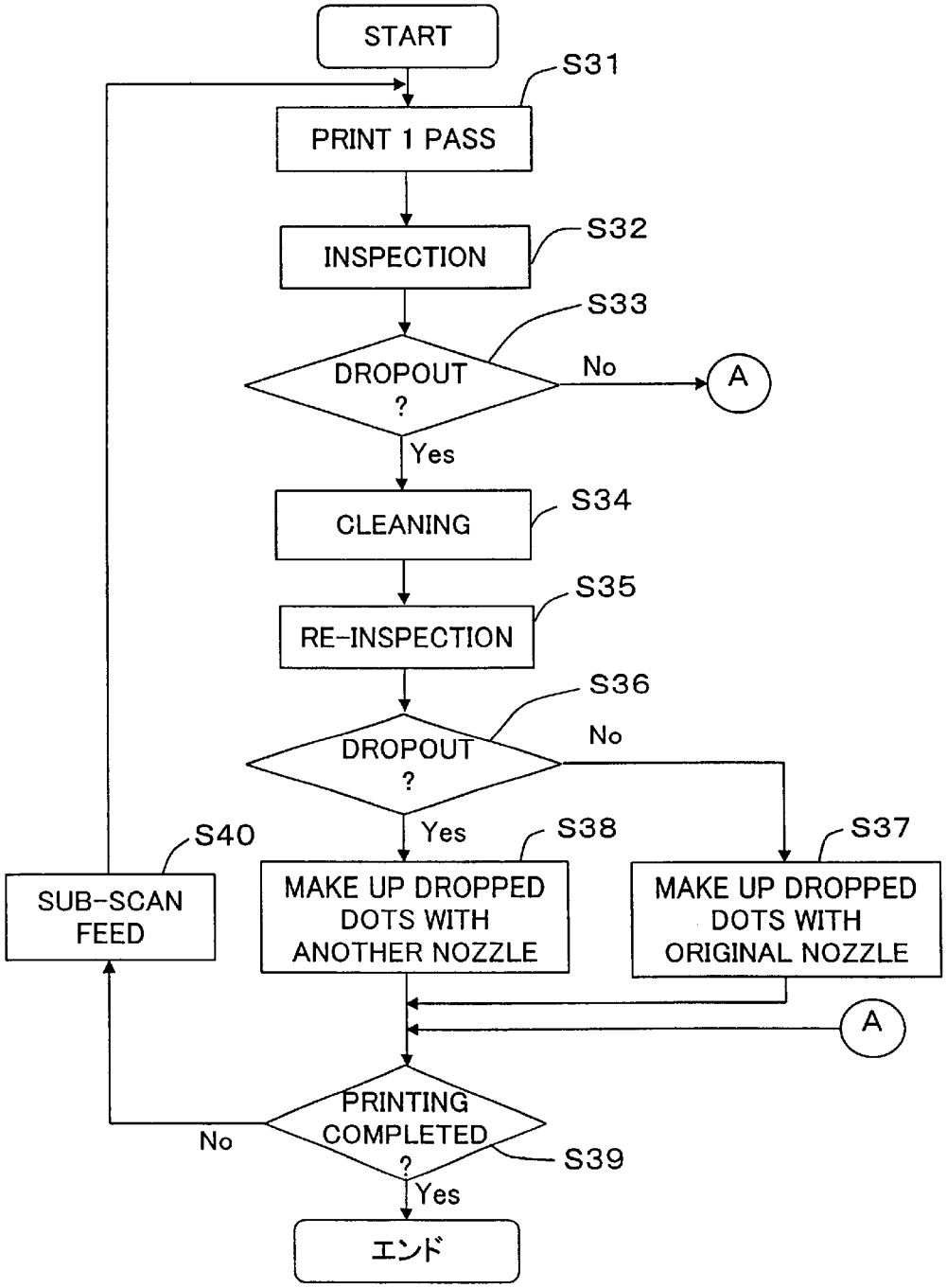

FIG. 11 is a flowchart showing a print processing procedure in a fourth embodiment of the present invention. In the fourth embodiment, dot dropout inspection is conducted after every main scan and nozzle cleaning is conducted when dot dropout is detected. First, a printing pass is conducted in step S31. Next, in step S32, the first dot dropout inspection unit 40 is used to conduct dot dropout inspection of all nozzles for six colors.

When no dot dropout is found in step S33, control passes to step S39, in which a check is made as to whether printing of one page has been completed. When it has not been completed, a sub-scan feed of an ordinary printing operation is conducted in step S40 and control is returned to step S31.

When the presence of dot dropout is found in step S33, nozzle cleaning is conducted in step S34. This cleaning can be carried out on all nozzles of the print head 36 or on only the clogged nozzle(s).

Next, in step S35, all nozzles are again inspected for dot dropout. If it is found in step S36 that all nozzle clogging has been eliminated, i.e., no dot dropout is present, control passes to step S37, in which a make-up operation is conducted with the original nozzle to make up the dropped dots. As no sub-scan feed is conducted between the printing pass in S31 and the make-up operation of step S37, the print head 36 remains at the same sub-scan position. Dot dropout can therefore be eliminated by using the nozzle freed of clogging to again record dots on the raster line that experienced dot dropout. After elimination of dot dropout in step S37, control is passed to step S39. When printing of one page has not been completed, a sub-scan feed of an ordinary printing operation is conducted in step S40 and control is returned to step S31.

On the other hand, when it is found in step S36 that nozzle clogging has not been eliminated, i.e., that dot dropout is present, a make-up operation is conducted with another nozzle in step S38 to make up the dropped dots. In other words, dots are recorded on the raster line that experienced dot dropout with another nozzle that is operative. The specific method for the processing of step S38 is the same as the one explained with regard to FIGS. 7(A)–7(B) and 8(A)–8(B). After this make-up operation, a check is made in step S39 as to whether printing of one page has been completed. When it has not been completed, a sub-scan feed is conducted in step S40 and control is returned to step S31. A high-quality image free of dot dropout can thus also be printed by carrying out inspection after each scan in this manner.

In the foregoing third and fourth embodiments, dot dropout inspection is conducted every scan and nozzle cleaning is conducted when dot dropout is detected. When the cleaning does not restore nozzle operation, a make-up operation is carried out using another nozzle that is operative. Moreover, when inspection is conducted after scanning (FIG. 11), the make-up operation is conducted using the restored nozzle if the cleaning restores nozzle operation. Therefore, even if dot dropout should occur in the course of a scan, the dot dropout can be quickly detected and the dot dropout on the printing medium can be easily eliminated.

Figure 12:
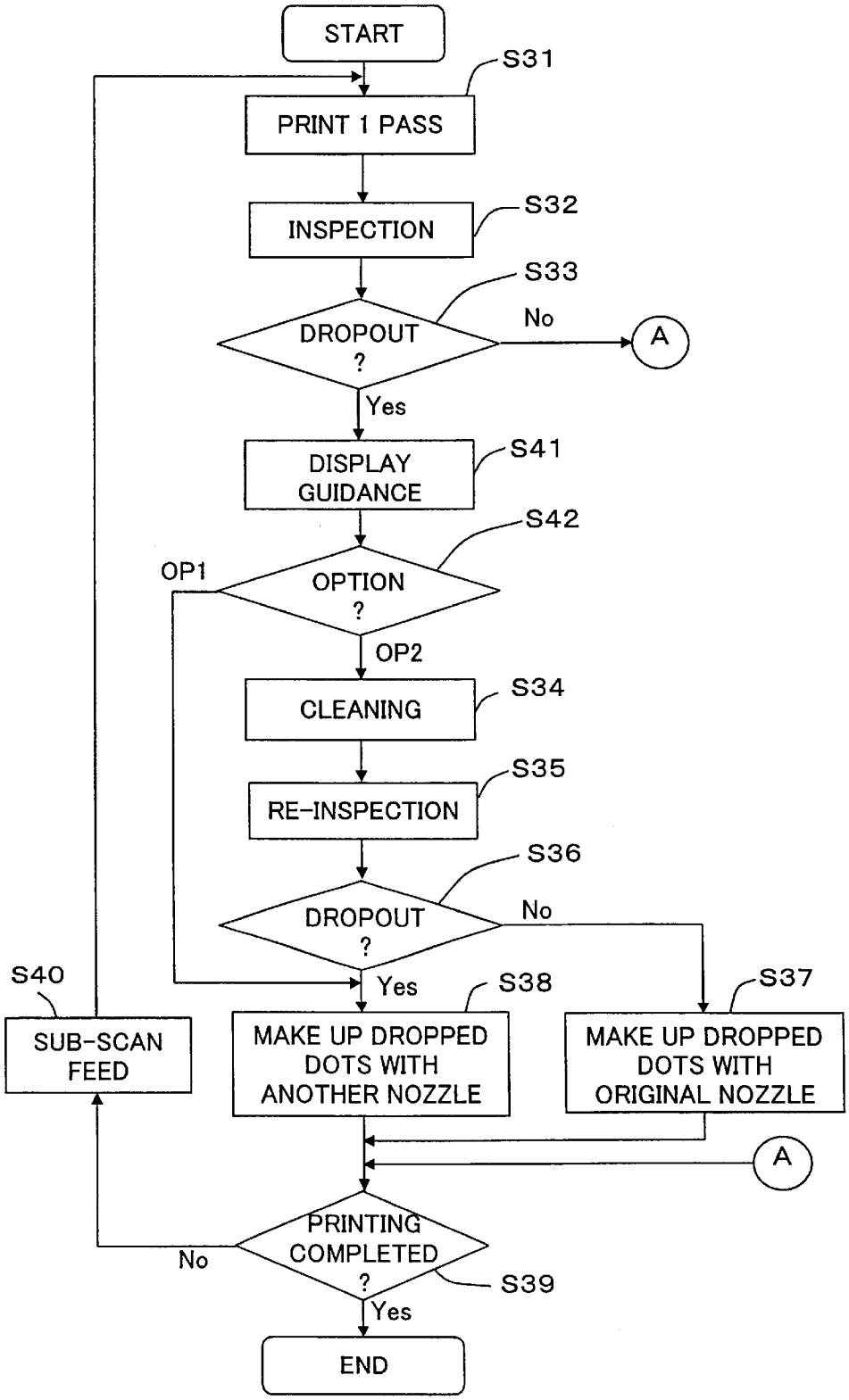
FIG. 12 is a flowchart showing a print processing procedure in a fifth embodiment.

FIG. 12 is a flowchart showing a print processing procedure in a fifth embodiment of the present invention. In the fifth embodiment, steps S41 and S42 are interposed between step S33 and step S34 of the fourth embodiment shown in FIG. 11. In other respects, the fifth embodiment is the same as the fourth embodiment.

Figure 13:
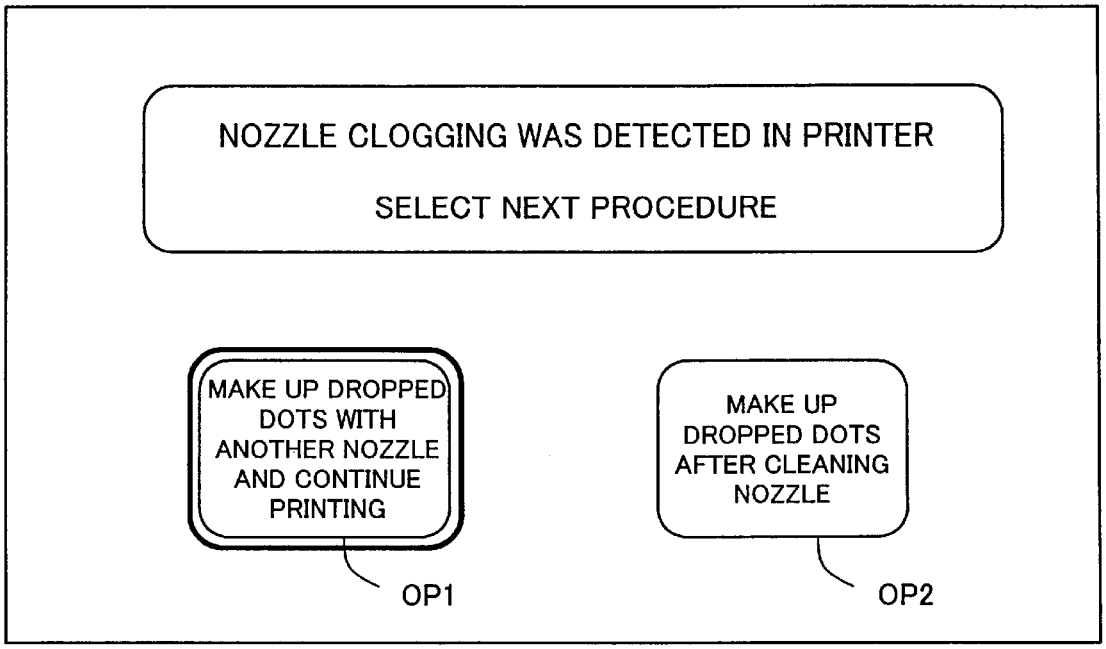
FIG. 13 is an explanatory diagram showing an example of a guidance display in the fifth embodiment.

When dot dropout is detected (step S33), control is passed to step S41, in which guidance for the user is displayed on a display of the host computer or a display panel of the printer. FIG. 13 is an explanatory diagram showing an example of the guidance display. An explanation reading "NOZZLE CLOGGING WAS DETECTED IN PRINTER SELECT NEXT PROCEDURE" and buttons indicating two procedure options, OP1 and OP2, are displayed on the guidance display. The first option, OP1, is to "MAKE UP DROPPED DOTS WITH ANOTHER NOZZLE AND CONTINUE PRINTING" and the second option, OP2, is to "MAKE UP DROPPED DOTS AFTER CLEANING NOZZLE." When the user a selects option OP1, control is passed from step S42 to step S38, in which the dropped dots are made up with another nozzle. On the other hand, when the user selects option OP2, control is passed from step S42 to step S34, in which nozzle cleaning is conducted. The processing in step S34 and the ensuing steps are the same as in the fourth embodiment. The guidance display and the user procedure selection described in the foregoing can also be similarly applied in the first to third embodiments.

Figure 14:
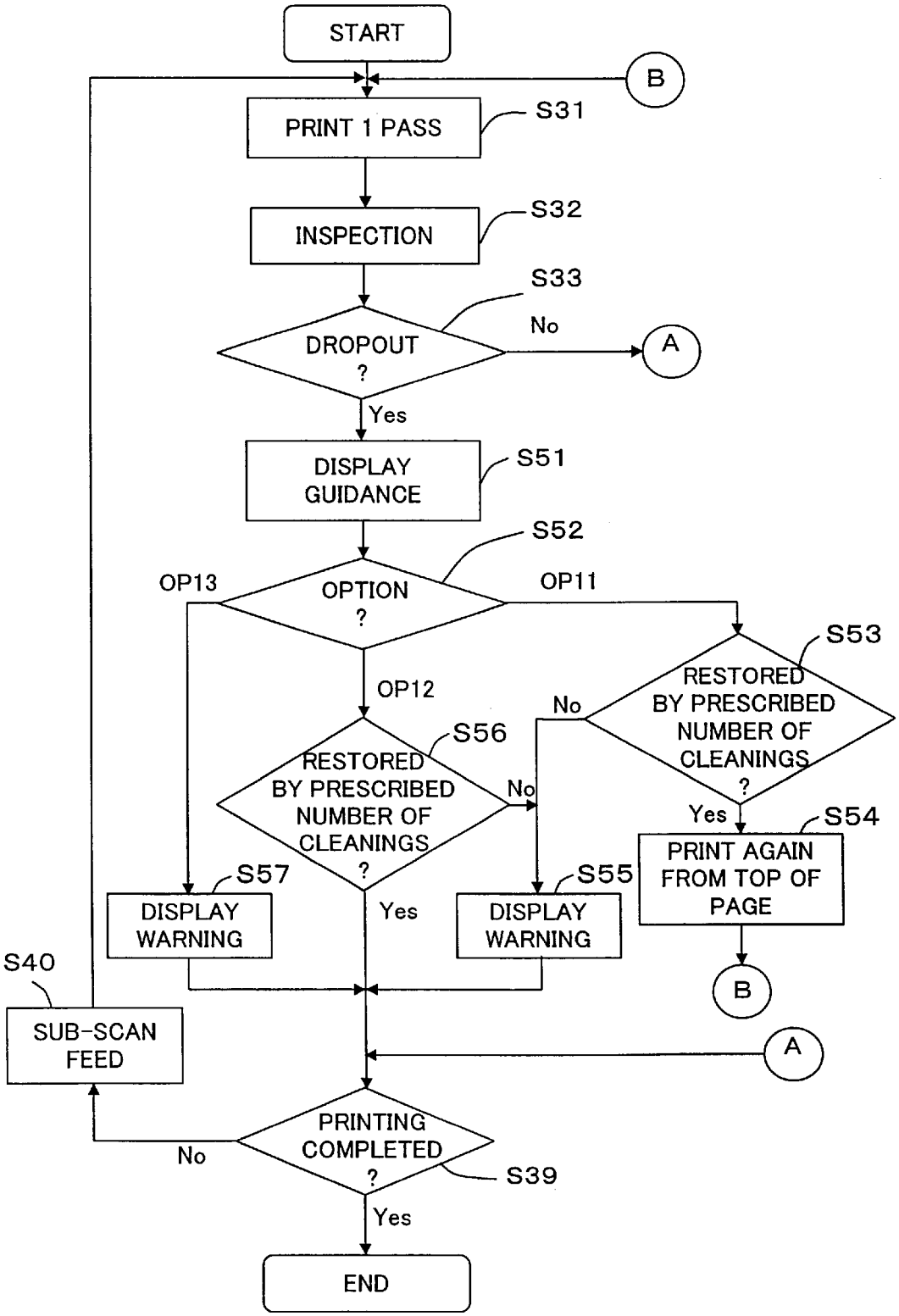
FIG. 14 is a flowchart showing a print processing procedure in a sixth embodiment.

FIG. 14 is a flowchart showing a print processing procedure in a sixth embodiment of the present invention. In the sixth embodiment, the procedures of steps S41, S42, and S34–S38 of the fifth embodiment shown in FIG. 12 are replaced with steps S51–S57. In other respects, the sixth embodiment is the same as the fifth embodiment.

Figure 15:
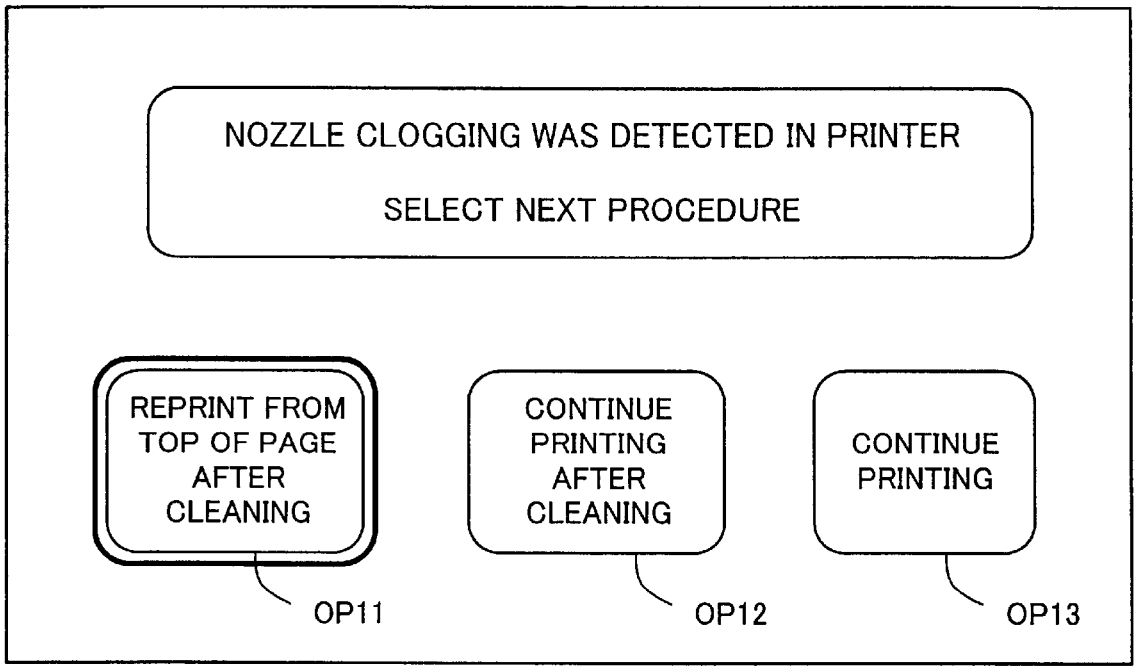
FIG. 15 is an explanatory diagram showing an example of a guidance display in a sixth embodiment.

When dot dropout is detected (step S33), control is passed to step S51, in which guidance for the user is displayed. FIG. 15 is an explanatory diagram showing an example of the guidance display in the sixth embodiment. The guidance display includes three options, OP11–OP13, differing from those of FIG. 13. The first option, OP11, is to "REPRINT FROM TOP OF PAGE AFTER CLEANING," the second option, OP12, is to "CONTINUE PRINTING AFTER CLEANING," and the third option, OP13, is to "CONTINUE PRINTING."

When the user selects option OP11, control is passed from step S52 to step S53, in which it checked whether or not nozzle operation was restored by a prescribed number of cleanings. Specifically, dot dropout inspection is conducted upon the completion of each cleaning and cleaning is discontinued when operation of the nozzle is restored. When operation of the nozzle is restored by the cleaning, the paper sheet being printed is discharged in step S54 and the page is reprinted from the top. When operation of the nozzle is not restored despite the prescribed number of cleanings, control is passed from step S54 to step S55, in which a warning is displayed on the display of the host computer or the display panel of the printer. The processing of step S39 and the ensuing steps is then continued. The displayed warning includes an explanation reading, for example, "NOZZLE DID NOT RECOVER BY CLEANING BUT PRINTING WAS CONTINUED." The display of this warning is preferably continued after completion of printing.

When the user selects option OP12, control is passed from step S52 to step S56, in which it is checked whether or not nozzle operation was restored by a prescribed number of cleanings. When the nozzle recovers, the print processing from step S39 onward is continued without conducting make-up processing. On the other hand, when the nozzle does not recover, a warning is displayed in step S55 and the processing of step S39 onward is conducted.

When the user selects option OP13, control is passed from step S52 to step S57, in which a warning is displayed. The processing of step S39 onward is then continued.

In the case of FIG. 14, print processing is continued without conducting make-up processing when operation of the nozzle is not restored by cleaning. Instead, however, a make-up operation can be conducted with another nozzle that is operative or a warning can be displayed and the print processing suspended.

In the foregoing fifth and sixth embodiments, the user is offered subsequent procedure options when dot dropout is detected. The processing procedure suitable for the circumstances can therefore be selected based on the user's judgment.

Rather than displaying guidance when dot dropout is detected, the user can be allowed to select the processing procedure following dot dropout detection beforehand, i.e., before starting the printing job. In this case, the processing following dot dropout detection is automatically conducted according to the processing procedure selected beforehand, without need for the user to monitor the printing condition during printing.

This invention is in no way limited to the embodiments and examples described in the foregoing but various modifications may be made without departing from the scope of the appended claims. For example, at least the following modifications (1)–(9) are possible.

(1) In the foregoing embodiments, some constituent elements implemented by hardware circuitry can be replaced by software and some constituent elements implemented by software can be replaced by hardware circuitry. A computer program may be provided as recorded on a floppy disk, CD-ROM, or other recording medium and may be stored in a memory (not shown) of the system controller 54. The system controller 54 will then execute the computer program to achieve some of the processing operations of the foregoing embodiments by executing the computer program.

(2) The present invention is generally applicable to printers of the type that jet ink droplets, but can be applied to various printers other than color inkjet printers. It can, for example, be applied to facsimile machines and copying machines employing inkjet systems.

(3) The foregoing embodiments were explained with regard to only the case of timing the dot dropout inspection to be conducted at every pass. However, the inspection timing can also be set in various other ways during the printing operation for each page. For example, inspection can be carried out after several printing passes. In other words, the present invention can in general be applied in the case of conducting dot dropout inspection in the course of the printing operation for each page.

In the foregoing embodiments, all nozzles are inspected during each inspection. It is, however, possible to inspect only some of the nozzles during each inspection. For instance, it is possible to inspect about ⅓ of the nozzles for each color per inspection after each scan and to complete the inspection of all nozzles in three inspections. Moreover, the nozzles to be inspected can be limited to those used in the printing job. For example, only the black ink nozzles can be inspected in monochrome printing and only the nozzles for the respective colors can be inspected in color printing. As will be understood from the foregoing explanation, it in general suffices for one dot dropout inspection to be conducted with respect to at least some nozzles among the nozzles used for the printing job.

(4) The foregoing embodiments were explained with regard to the case in which a single printer is equipped with three dot dropout inspection units 40, 41, and 42. It is adequate, however, for the printer to be equipped with at least one dot dropout inspection unit.

(5) In the foregoing embodiments, a make-up operation using another nozzle is initiated when nozzle clogging is not eliminated by a single cleaning. It is, however, possible to adopt an arrangement in which a make-up operation is initiated only when nozzle clogging is not eliminated by two or more cleanings. Thus, in general, it suffices to initiate a make-up operation when nozzle clogging is not eliminated by a prescribed number of cleanings.

(6) Dot dropout is conspicuous on some printing media and is inconspicuous on others. For example, dot dropout is conspicuous on special inkjet printing paper but is not conspicuous on plain copy machine paper. When a printing medium that does not make dot dropout conspicuous is used, therefore, no make-up operation need be conducted until a prescribed number of nozzles have clogged. When such an arrangement is adopted, degradation of image quality can be prevented without greatly reducing printing speed.

(7) Dot dropout is conspicuous with some kinds of printed images and is not conspicuous with others. For example, dot dropout is conspicuous in photographic images but is not conspicuous in text images containing only characters or in graphic images composed of figures, such as graphs, and characters. A text image, graphic image, or other such printed image that does not include a photographic image is referred to as a "non-photographic image" in this description. In the case of printing such a non-photographic image, an arrangement can be adopted in which no make-up operation is conducted until a prescribed number of nozzles have clogged. When the make-up operation is to be adjusted depending on the type of printed image in this manner, information indicating the type of printed image can be recorded in, for example, the header of the print data sent from the computer to the printer.

(8) Dot dropout is conspicuous in some print modes and is not conspicuous in others. There is, for instance, a print mode in which only ¼ of all pixels on a number of raster lines are recorded by one pass, and all pixels on the raster lines are recorded by four passes. The greater the number of passes, the less conspicuous dot dropout becomes. Therefore, an arrangement can be adopted wherein when the number of passes required for serving all pixel positions on the raster lines is equal to or greater than a prescribed number no make-up operation is conducted until a prescribed number of nozzles have clogged.

(9) An arrangement can be adopted wherein when dot dropout is detected in a prescribed region near the end of the print region on the printing medium a make-up operation using another nozzle is immediately initiated without cleaning. For example, a make-up operation can be conducted without conducting cleaning in the final approximately ⅓ (or ¼) region of the printing paper sheet. This shortens the printing time.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A printing method for printing images by jetting ink droplets from each of a plurality of nozzles during main scanning to record dots on a surface of a printing medium, the method comprising the steps of:

(a) inspecting for a presence/absence of jetting of ink droplets from nozzles subject to inspection, during a printing operation that does not print a test pattern, to determine whether each nozzle subject to inspection is an operative nozzle capable of jetting ink droplets or an inoperative nozzle incapable of jetting ink droplets; and (b) when an inoperative nozzle is detected by the inspection, conducting a make-up operation for recording dots that should have been recorded by the inoperative nozzle.

2. A printing method according to claim 1, wherein the step (a) is conducted at every main scan during an ordinary printing operation when no inoperative nozzle is present.

3. A printing method according to claim 2, wherein the make-up operation is an operation of recording only dots on a main scanning line that should have been recorded by the inoperative nozzle using another active nozzle.

4. A printing method according to claim 3, wherein the step (b) includes the steps of:

i) before the make-up operation, conducting a sub-scan feed of a transient first feed amount in order to position the another active nozzle on the main scanning line including the dots that should have been recorded by the inoperative nozzle; and ii) conducting the make-up operation using the another active nozzle;

iii) after the make-up operation, conducting a sub-scan feed amount of a transient second feed amount in order to position the plurality of nozzles at a nozzle position of a next main scan of the ordinary printing operation.

5. A printing method according to claim 1, wherein the step (b) includes the steps of:

i) cleaning at least the inoperative nozzle when the inspection detects the inoperative nozzle; and ii) conducting the make-up operation using another active nozzle when operation of the inoperative nozzle is not restored by a prescribed number of cleanings.

6. A printing method according to claim 5, wherein step (a) is conducted at every main scan during an ordinary printing operation when no inoperative nozzle is present.

7. A printing method according to claim 6, wherein the step (b) further includes the step of:

when operation of the inoperative nozzle is restored within the prescribed number of cleanings, conducting the make-up operation for recording dots that should have been recorded by the inoperative nozzle using the restored active nozzle.

8. A printing method according to claim 7, wherein the make-up operation is an operation of recording only dots on a main scanning line that should have been recorded by the inoperative nozzle using the another active nozzle or the restored active nozzle.

9. A printing method according to claim 6, wherein the step (b) includes the steps of:

i) before the make-up operation, conducting a sub-scan feed of a transient first feed amount in order to position another active nozzle on the main scanning line including the dots that should have been recorded by the inoperative nozzle; and ii) conducting the make-up operation using the another active nozzle;

iii) after the first make-up operation, conducting a sub-scan feed of a transient second feed amount in order to position the plurality of nozzles at a nozzle position of a next main scan of the ordinary printing operation.

10. A printer for printing images by jetting ink droplets from each of a plurality of nozzles during main scanning to record dots on a surface of a printing medium, comprising:

an inspection unit configured to inspect a presence/absence of jetting of ink droplets from nozzles subject to inspection, during a printing operation that does not print a test pattern, to determine whether each nozzle subject to inspection is an operative nozzle capable of jetting ink droplets or an inoperative nozzle incapable of jetting ink droplets; and a make-up operation unit configured to conduct, when an inoperative nozzle is detected by the inspection, a make-up operation for recording dots that should have been recorded by the inoperative nozzle.

11. A printer according to claim 10, wherein the inspection unit conducts the inspection at every main scan during an ordinary printing operation when no inoperative nozzle is present.

12. A printer according to claim 11, wherein the make-up operation is an operation of recording only dots on a main scanning line that should have been recorded by the inoperative nozzle using another active nozzle.

13. A printer according to claim 11, wherein before the make-up operation the makeup operation unit conducts a sub-scan feed of a transient first feed amount in order to position another active nozzle on the main scanning line including the dots that should have been recorded by the inoperative nozzle;

the another active nozzle conducts the make-up operation; and after the make-up operation unit conducts a sub-scan feed amount of a transient second feed amount in order to position the plurality of nozzles at a nozzle position of a next main scan of the ordinary printing operation.

14. A printer according to claim 10, further comprising:

a cleaning unit configured to clean at least the inoperative nozzle when the inspection detects the inoperative nozzle; and wherein the make-up operation unit conducts the make-up operation using another active nozzle when operation of the inoperative nozzle is not restored by a prescribed number of cleanings.

15. A printer according to claim 14, wherein the inspection unit conducts the inspection at every main scan during a printing operation when no inoperative nozzle is present.

16. A printer according to claim 15, wherein when operation of the inoperative nozzle is restored within the prescribed number of cleanings, the make-up operation unit conducts the make-up operation for recording dots that should have been recorded by the inoperative nozzle using the restored active nozzle.

17. A printer according to claim 16, wherein the make-up operation is an operation of recording only dots on a main scanning line that should have been recorded by the inoperative nozzle using the another active nozzle or the restored active nozzle.

18. A printer according to claim 15, wherein before the make-up operation the make-up operation unit conducts a sub-scan feed of a transient first feed amount in order to position the another active nozzle on the main scanning line including the dots that should have been recorded by the inoperative nozzle;

the another active nozzle conducts the make-up operation; and after the make-up operation the make-up operation unit conducts a sub-scan feed of a transient second feed amount in order to position the plurality of nozzles at a nozzle position of a next main scan of the ordinary printing operation.

19. A computer readable storage medium storing a computer program for causing a computer including a printer for printing images by jetting ink droplets from each of a plurality of nozzles during main scanning to record dots on a surface of a printing medium, the computer program causing the computer to implement:

an inspection function for inspecting a presence/absence of jetting of ink droplets from nozzles subject to inspection, during a printing operation that does not print a test pattern, to determine whether each nozzle subject to inspection is an operative nozzle capable of jetting ink droplets or an inoperative nozzle incapable of jetting ink droplets; and a make-up operation function for, when an inoperative nozzle is detected by the inspection, conducting a make-up operation for recording dots that should have been recorded by the inoperative nozzle.

20. A storage medium according to claim 19, wherein the inspection is conducted at every main scan during an ordinary printing operation when no inoperative nozzle is present.

21. A storage medium according to claim 19, the compram causing the computer to further implement:

a cleaning function for cleaning at least the inoperative nozzle when the inspection detects the inoperative nozzle; and wherein the make-up operation is conducted using another active nozzle when operation of the inoperative nozzle is not restored by a prescribed number of cleanings.

22. A storage medium according to claim 21, wherein the inspection is conducted at every main scan during an ordinary printing operation when no inoperative nozzle is present.

23. A printing method for printing images by jetting ink droplets from each of a plurality of nozzles during main scanning to record dots on a surface of a printing medium, the printing method comprising the steps of:

(a) inspecting for a presence/absence of jetting of ink droplets from nozzles subject to inspection, during a printing operation that does not print a test pattern, to determine whether each nozzle subject to inspection is an operative nozzle capable of jetting ink droplets or an inoperative nozzle incapable of jetting ink droplets; and (b) when an inoperative nozzle is detected by the inspection, conducting processing after the inspection in accordance with a processing procedure selected by a user.

24. A printing method according to claim 23, wherein the step (b) includes the step of:

displaying a plurality of processing procedures among which the user can select one; and wherein conducting the processing after the inspection is conducted in accordance with the processing procedure selected by the user from among the plurality of processing procedures.

25. A printing method according to claim 23, wherein the processing after the inspection is conducted in accordance with a processing procedure selected by the user before start of printing from among a plurality of processing procedures.

26. A printer for printing images by jetting ink droplets from each of a plurality of nozzles during main scanning to record dots on a surface of a printing medium, the printer comprising:

an inspection unit configured to inspect a presence/absence of jetting of ink droplets from nozzles subject to inspection, during a printing operation that does not print a test pattern, to determine whether each nozzle subject to inspection is an operative nozzle capable of jetting ink droplets or an inoperative nozzle incapable of jetting ink droplets; and a controller configured to conduct, when an inoperative nozzle is detected by the inspection, processing after the inspection in accordance with a processing procedure selected by a user.

27. A printer according to claim 26, further comprising:

a display device configure to display a plurality of processing procedures among which the user can select one; and wherein the controller conducts the processing after the inspection in accordance with the processing procedure selected by the user from among the plurality of processing procedures.

28. A printer according to claim 26, wherein the controller conducts the processing after the inspection in accordance with a processing procedure selected by the user before start of printing from among a plurality of processing procedures.

29. A computer readable storage medium storing a computer program for causing a computer including a printer for printing images by jetting ink droplets from each of a plurality of nozzles during main scanning to record dots on a surface of a printing medium, the computer program causing the computer to implement:

an inspection function for inspecting a presence/absence of jetting of ink droplets from nozzles subject to inspection, during a printing operation that does not print a test pattern, to determine whether each nozzle subject to inspection is an operative nozzle capable of jetting ink droplets or an inoperative nozzle incapable of jetting ink droplets; and a control function for, when an inoperative nozzle is detected by the inspection, conducting processing after the inspection in accordance with a processing procedure selected by a user.

* * * * *

UNITED STATES PATENT AND TRADEMARK OFFICE

CERTIFICATE OF CORRECTION

PATENT NO. : 6,478,400 B1
DATED : November 12, 2002
INVENTOR(S) : Endo

It is certified that error appears in the above-identified patent and that said Letters Patent is hereby corrected as shown below:

Title page, Item [54] and Column 1, lines 1-4,
Should read:

-- PRINTING METHOD AND PRINTER THAT EFFECT DOT DROPOUT INSPECTION AND RECORDING MEDIUM PRERECORDED WITH PROGRAM THEREFOR --

Signed and Sealed this

Fifteenth Day of April, 2003

JAMES E. ROGAN
*Director of the United States Patent and Trademark Office*